United States Patent [19]

Shibata

[11] 4,393,737

[45] Jul. 19, 1983

[54] JULIENNE CUTTER FOR FOOD PROCESSORS

[75] Inventor: Koichiro Shibata, Seto, Japan

[73] Assignee: Cuisinarts, Inc., Greenwich, Conn.

[21] Appl. No.: 231,592

[22] Filed: Feb. 5, 1981

[51] Int. Cl.[3] ..... B26D 3/26

[52] U.S. Cl. ..... 83/356.3; 83/592; 241/92; 241/282.2

[58] Field of Search ..... 241/92, 282.1, 282.2, 241/298, 292, 273.1, 273.2; 83/356.3, 355, 592

[56] References Cited

U.S. PATENT DOCUMENTS 4,198,887 4/1980 Williams, Jr. ..... 241/92 X 4,256,265 3/1981 Madan ..... 241/92

*Primary Examiner*—Mark Rosenbaum

*Attorney, Agent, or Firm*—Parmelee, Bollinger & Bramblett

[57] ABSTRACT

A julienne cutter is provided having a hub removably engageable with the drive of a food processor and a disc-like member secured to the hub. The disc-like member has an opening extending from a region near the hub to a region near the periphery and there is an elevated portion on the member located behind the opening with respect to the direction of rotation of the disc-like member. A unitary cutting structure is positioned in the opening for producing multiple closely spaced cuts and is formed of sheet metal having an elongated lower portion and an elevated elongated upper portion secured to the underside and to the elevated portion of the disc-like member, respectively. A plurality of relatively closely spaced blades extend upwardly generally perpendicular to and are located between and are integral wiht the elongated lower and elevated upper portions of the cutting structure. These blades are sharpened on their leading edges and are formed with the sharpened leading edges of the elevated elongated portion facing forward in the direction of the rotation of the disc for simultaneously producing horizontal and vertical cuts for forming clean, crisp, neat julienne food strips. The integral blades are formed by slitting a sheet of blade metal in a diagonal fashion and then bending the strips formed between the slits perpendicular to the plane of the resulting elongated lower and elevated upper portions of the sheet metal.

5 Claims, 8 Drawing Figures

JULIENNE CUTTER FOR FOOD PROCESSORS

BACKGROUND OF THE INVENTION

This invention relates to rotary tools for food processors, and more particularly to a julienne cutter tool for uniformly and cleanly cutting and slicing food items into julienne strips and similar types of strips.

Food processors to which the present invention relates are characterized by having a working bowl mountable on a base with tool drive means extending into the bowl for rotating a food processing tool in the bowl. Various selected rotary tools can be engaged on and driven by the drive means for performing many different food processing operations, as may be desired by the user. A detachable cover is secured over the top of the bowl during use, and the cover includes a hopper or feed tube which has a passageway extending downwardly through the cover into the bowl. Food items to be prepared may be placed in the feed tube and are then manually pushed down through the feed tube into the bowl by means of a removable pusher member which is adapted to slide down into the feed tube in the manner of a plunger. Further information with respect to food processors and their tools may be obtained by reference to U.S. Pat. Nos. 3,985,304—Sontheimer; 4,198,887—Williams; 4,200,244—Sontheimer; 4,216,917—Clare and Sontheimer; and 4,227,655—Williams.

The various interchangeable rotary tools which may be used in the food processor include slicing discs, grating discs, rasping discs, etc. which have a disc-like tool member formed of sheet metal, preferably of stainless steel, with one or more cutting elements projecting above the upper surface of the disc. These tools with their disc-like cutting member are intentionally positioned in the top of the bowl near the lower surface of the cover where they can perform the cutting operations on the food items introduced downwardly from the feed tube into the top of the bowl.

For the purpose of positioning the disc-like member in the top of the bowl, such a rotary tool may have a relatively long hollow hub extending down into the bowl which slides down into engagement around tool drive means or otherwise provides a driving connection between the tool hub and drives means extending into the bowl, to facilitate the quick and convenient mounting and replacement of the various disc-like cutting tools.

The present invention is directed to the type of rotary cutting tool which cuts food items such as potatoes, carrots, fruits, vegetables and other food items into julienne strips or similar strips. These strips are characterized by each having a small rectangular or square cross section which requires the item to be sliced simultaneously along perpendicular planes. U.S. Pat. No. 4,198,887 entitled "Julienne Cutter Tool," describes one type of rotary disc tool for cutting julienne strips from food items. Although the aforesaid julienne disc is suitable for performing the desired food processing operation, the present invention is directed to improvements in a julienne disc type of tool.

SUMMARY OF THE INVENTION

It is an object of the present invention to provide a new and improved julienne rotary cutter tool for food processors which will repeatedly process food items applied thereto into clean, crisp, neat and uniform julienne strips or similar strips having a small rectangular or square cross section.

A further object of this invention is to provide a new and improved julienne cutter tool for food processors which is rugged, reliable and easier to fabricate than existing julienne rotary cutter tools.

In carrying out this invention in one illustrative embodiment thereof, a julienne cutter tool is provided for use in rotary food processors of the type described above. The julienne cutter tool has a hub removably engageable with drive means in the working bowl to be rotated in a predetermined direction about an axis. The disc-like member has an opening therein extending from a region near the hub to a region near the periphery of the disc-like member. Behind this opening with respect to the direction of rotation there is an elevated platform portion of the disc-like member which defines the region located behind the opening.

A cutting structure is positioned in the opening for producing multiple, closely spaced cuts simultaneously horizontal and vertical in the food items applied thereto, with the cut strips passing through the opening into the bowl. The cutting structure is unitary and is formed of sheet metal having an elongated lower portion and an elevated elongated upper portion. This lower portion is secured to the underside of the disc-like member on the leading edge of the opening as defined by the direction of rotation and the elevated elongated upper portion is secured on the elevated platform portion of the disc-like member.

A plurality of closely spaced blades extend upwardly generally perpendicular to the plane of the disc-like member. These blades are located between and are integral with the elongated lower and upper portions of the unitary cutting structure. These blades are sharpened along their leadings edges facing the direction of rotation. Also, each leading edge of the elevated elongated portion of the cutting structure facing the direction of rotation is provided with a sharp edge, whereby said blades in cooperation with the sharp leading edges of the elevated elongated portion simultaneously produce horizontal and vertical cuts in food items applied thereto for forming elongated julienne strips or similar types of food strips, which are clean, crisp, neat and uniform.

Advantageously, the unitary nature of the cutting structure provides strength for the entire julienne disc by virtue of being mounted in the opening in the disc extending both above and below the disc with the multiple blades spanning across between the front and rear edges of the opening like multiple braces for resisting deformation of the opening under the stress of continual impact of such an opening with the food items which are being sliced. The rugged nature of the formation of the cutting structure enhances the performance of this julienne disc tool through repeated use and provides for uniform, cleancut julienne strips after repeated use.

BRIEF DESCRIPTION OF THE DRAWINGS

The invention together with further objects, aspects and advantages thereof, will become more clearly and fully understood from the following description considered in conjunction with the accompanying drawings, in which the same reference numbers are used to indicate the same elements or components throughout the various FIGURES.

DESCRIPTION OF THE PREFERRED EMBODIMENTS

Figure 1:
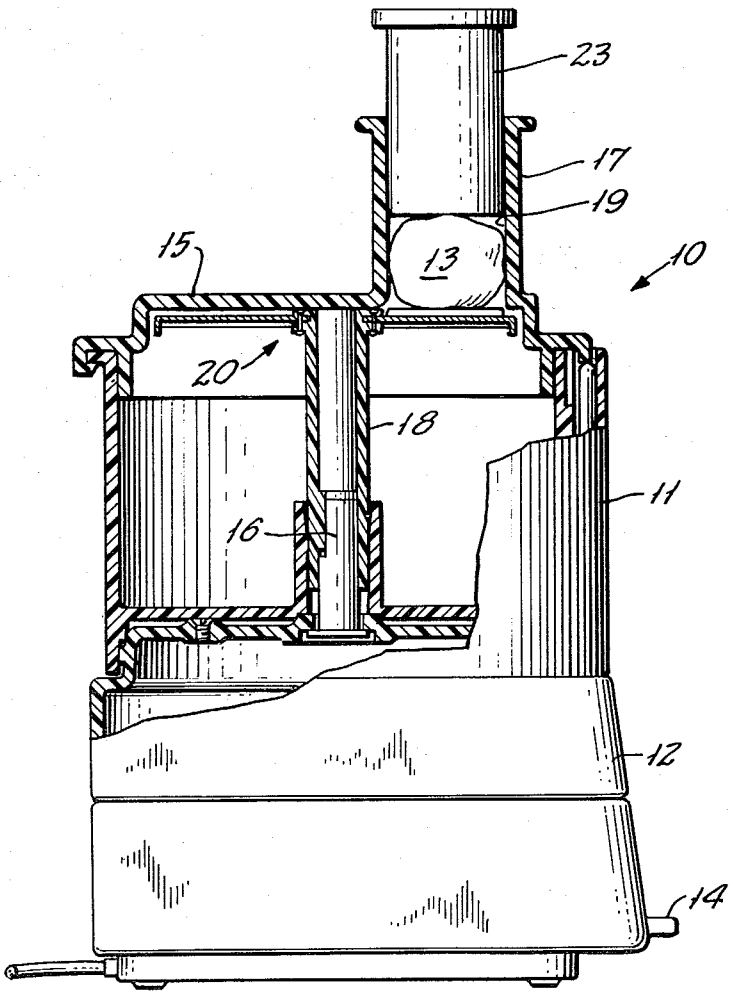
FIG. 1 is an elevational view, shown partly in section, of a food processor in which the julienne cutter tool of the present invention may be employed.

Referring now to FIG. 1, a typical food processor, referred to generally by the reference number 10, has a base 12 with control levers 14 for controlling the drive motor. There is a removably mountable upright working bowl 11 on the base 12 with tool drive means 16 in the form of motor driven shaft extending into the bowl. A rotary julienne cutter, referred to generally by the reference number 20, includes an elongated hub portion 18 which is removably engageable upon the tool drive means 16 for producing relatively high speed rotation of the julienne cutter 20 around a vertical axis 21 (FIG. 3) in the bowl 11. The julienne cutter is driven in a predetermined direction 27 in the range from 700 to 1,800 RPM. A removable cover 15 closes the bowl 11 when in use, and the cover 15 is provided with a feed tube 17 defining a feed passage 19 therethrough for introducing food times 13 into the bowl. A removable food pusher member 23 is adapted to slide down into the feed passageway 19 to act as a plunger for manually pushing food items 13 into contact with the upper surface of the rotary cutter tool 20, and the resulting cut strips of food pass down into the working bowl 11 after being cut by the rotary tool 20. In summary, food items 13 introduced through the feed tube 17 are cut by the julienne cutter 20, and the resultant julienne strips are deposited in the bowl 11.

Figure 2:
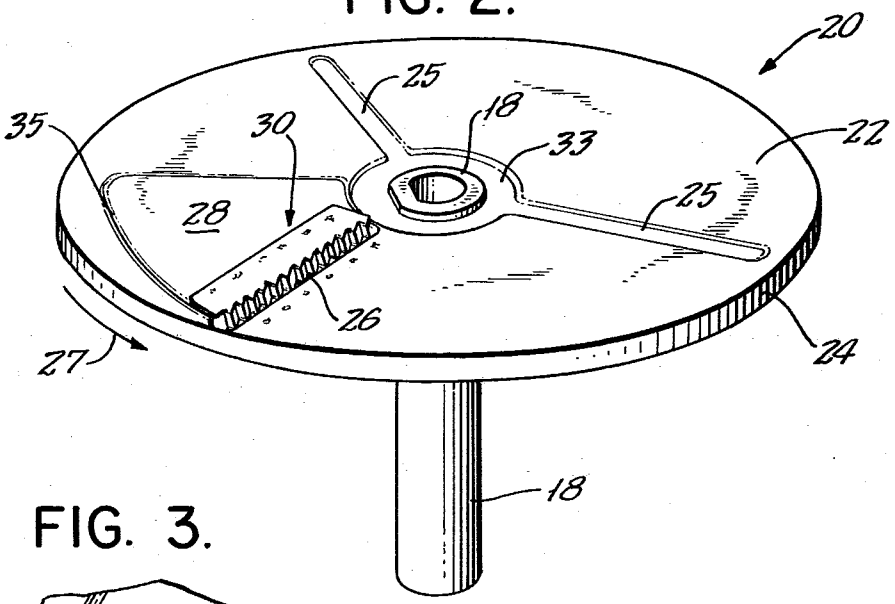
FIG. 2 is a perspective view of a new and improved julienne rotary cutter tool embodying the present invention.

As is illustrated in FIG. 2, the julienne cutter tool 20 includes a disc-like member 22 of stainless steel having a depending peripheral flange or rim 24. The disc 22 is mounted on the hub 18 which is engageable with the drive means 16 of the food processor 10. The disc member 22 is shown stiffened by embossing or stamping radial ribs 25 into it. Also, as seen in FIGS. 2 and 5 the central area 33 of the disc 22 around the hub 18 is stamped down below the level of the main area of the disc 22 so that this central area 33 merges into the stiffening ribs 25.

As will be seen in FIGS. 2, 3, 4, 5 and 7 the disc 22 includes an elongated and relatively narrow opening or slot 26 which extends from a position near the hub 18 to a position near the periphery of the disc 22. An area 28 of the disc 22 is displaced upwardly by a stamping operation to provide an elevated platform portion which is elevated above the disc-like member 22. This elevated platform 28 slopes down to the level of the disc in a sloping shoulder 35. This elevated platform 28 extends along and behind the edge region 29 (FIG. 7) of the slot 26, relative to the direction of the rotation of the tool, as indicated by the arrow 27. This elevated platform 28 extends parallel with the plane of the disc-like member 22. The top surface of this platform 28 is at an elevated location significantly above the main area of the top surface of the disc member 22.

It is within the slot 26 that the julienne cutting structure, referred to generally by the reference number 30, is positioned and secured. This julienne cutting structure 30 is secured in place in the slot 26 by attachment as seen in FIG. 7 to the underside of the disc 22 in the region immediately in front of the slot 26 and by attachment to the top of the leading edge portion 29 of the elevated platform, respectively.

Figure 4:
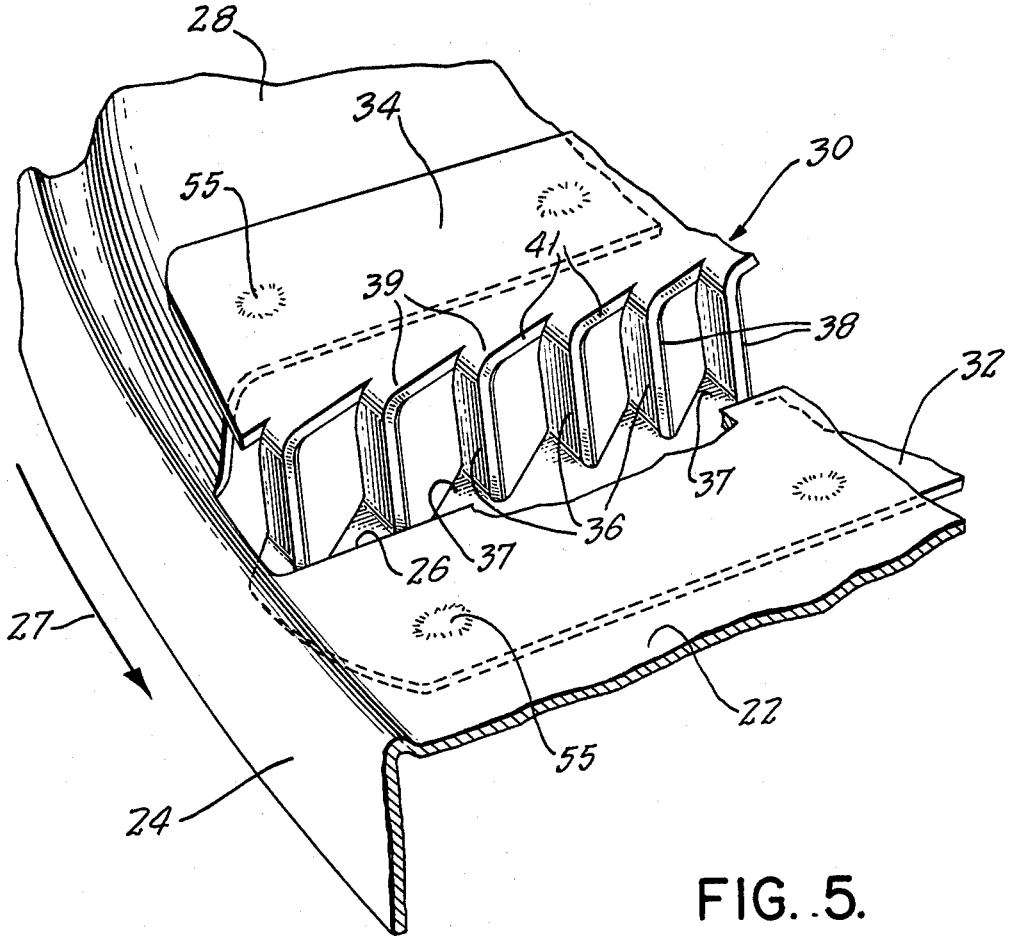
FIG. 4 is a greatly enlarged perspective view of a portion of the outer end of the cutting structure illustrated in FIG. 3.
Figure 5:
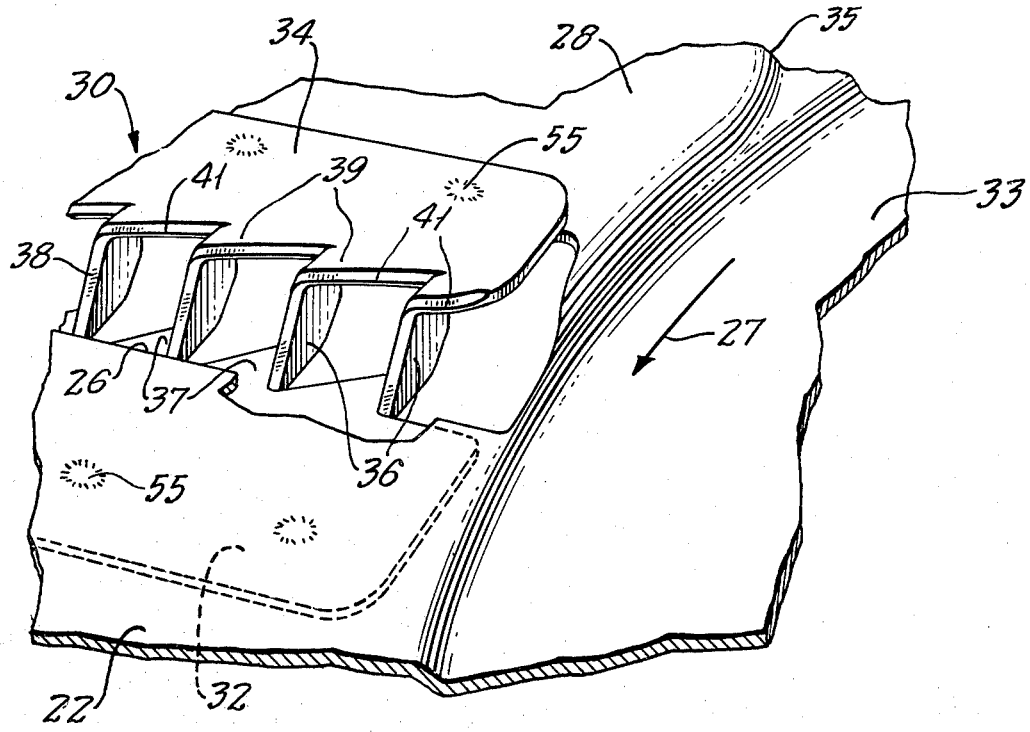
FIG. 5 is a greatly enlarged perspective view of the inner end of the cutting structure illustrated in FIG. 3.

The unitary julienne cutting structure 30 as seen in FIGS. 4 through 8 is formed from sheet blade metal having an elongated lower portion 32 and an elevated elongated upper portion 34 which are separated in elevation. Each of these elongated sheet metal portions 32 and 34 is integrally connected by a plurality of relatively closely spaced blades 36. These blades 36 are arranged in a row extending radially with respect to the axis of rotation, this row of the blades 36 being aligned within the radial slot 26. These blades are individually oriented generally perpendicular to both the elongated lower portion 32 and the elevated elongated upper portion 34 of the cutting structure 30. The blades 36 are characterized (as seen in FIGS. 4 and 5) by each having a planar lower triangular gusset base 37 which integrally joins the blade to the elongated lower portion 32 and by each having a similar planar upper triangular gusset base 39 which integrally joins the blade to the elevated elongated upper portion 34 of the cutting structure 30. The lower and upper triangular bases 37 and 39 for each blade are inverted with respect to each other, i.e., they extend in opposite directions from each side of each respective blade 36. These triangular base portions 37 and 39 constitute supports and guides for the julienne strips as they are being cut and pass through the unitary cutting structure 30.

As is shown in FIGS. 4 and 5, the metal near the leading edges 38 of the blades 36 is ground away to provide sharpened cutting edges which thus form a plurality of parallel, radially spaced knife edges 38 uniformly spaced along a row extending radially in the opening 26. The metal near the leading edges 41 of the planar upper triangular bases 39 of the blades 36 is also sharpened which in effect forms a series of horizontally aligned knife edges 41. These horizontal cutting edges 41 together with the vertical cutting edges 38 provide a sequence of inverted U-shaped knife elements as seen most clearly in FIG. 6. These inverted U-shaped knife elements along with the top surface of the disc 22 form a series of square or rectangular shaped openings 42 extending in a row radially outward from near the hub 18 to near the periphery of the disc 22, thus occupying the length of the opening 26.

Figure 3:
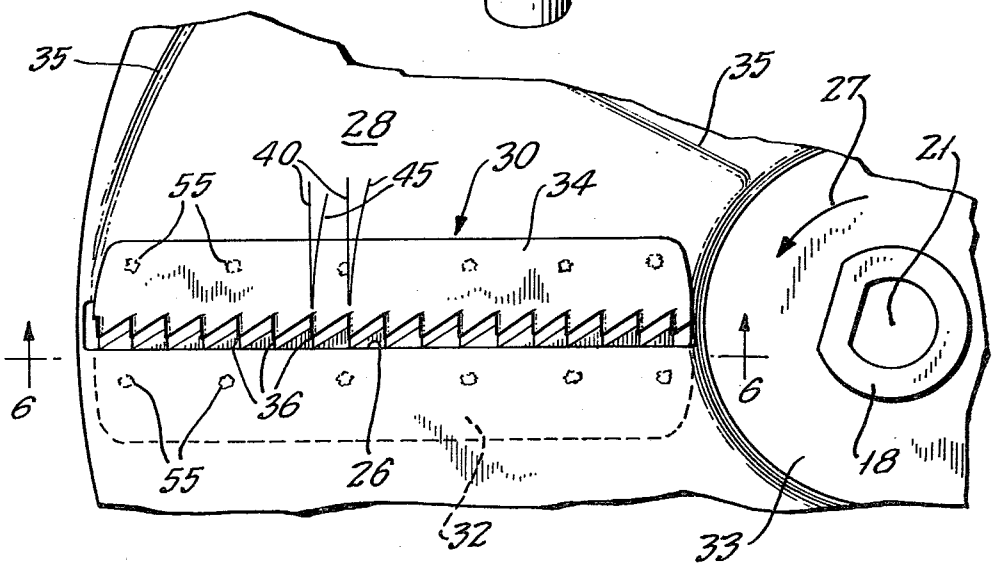
FIG. 3 is an enlarged top view of the julienne cutter of FIG. 2 particularly illustrating the cutting structure.
Figure 6:
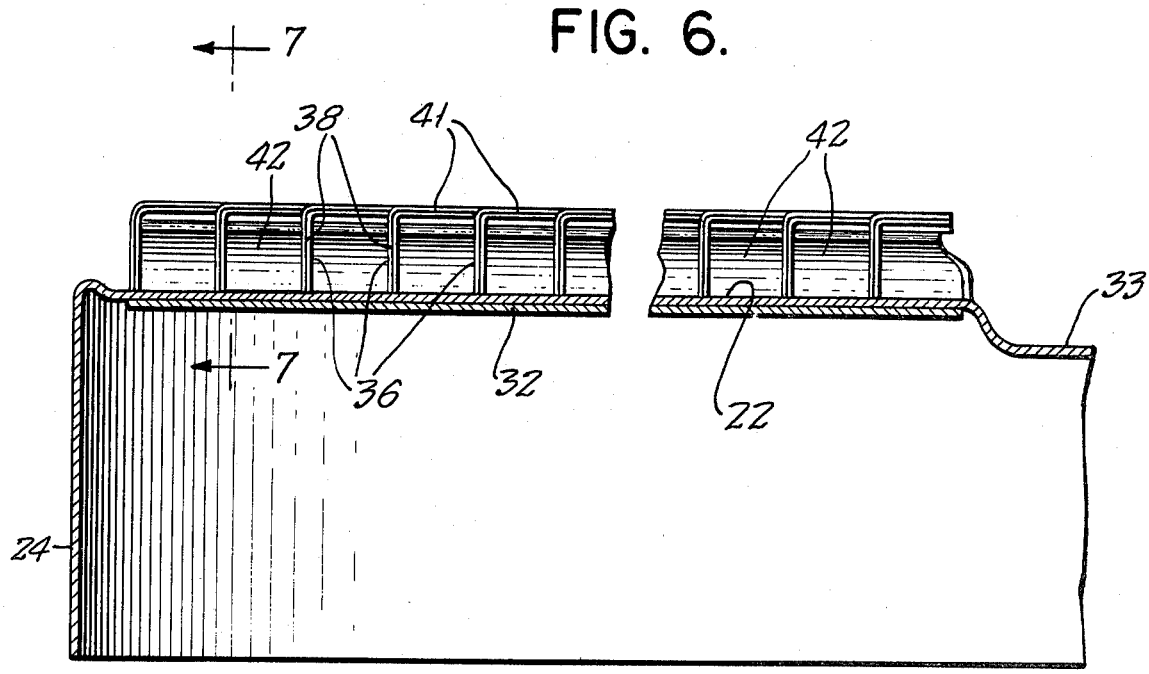
FIG. 6, is an enlarged cross-sectional view taken along line 6—6 in FIG. 3 looking toward the cutting edges of this julienne tool.
Figure 7:
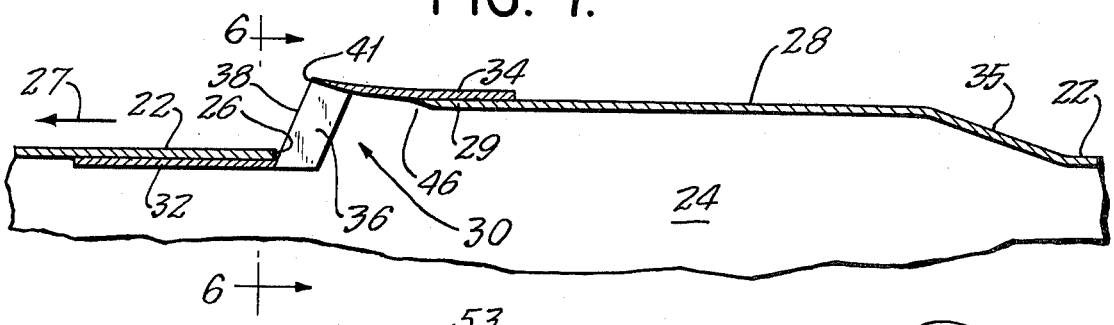
FIG. 7 is a cross-sectional view taken along line 7—7 of FIG. 6.

Advantageously, as seen in FIG. 7, the cutting edges 38 of the blades 36 slope upwardly and rearwardly, thereby providing a progressive slicing cutting action because each of these cutting edges 38 impinges against the food item in a progressive manner. Similarly, as seen most clearly in FIGS. 3 and 4, each of the horizontal cutting edges 41 slopes radially inwardly and rearwardly for producing an advantageous progressive slicing cutting action. As seen in FIGS. 3 and 6, the plane 40 of each individual blade 36 is advantageously tangent to a respective circle 45 concentric about the axis of rotation 21. Thus each blade 36 cuts cleanly and neatly through the food item.

Figure 8:
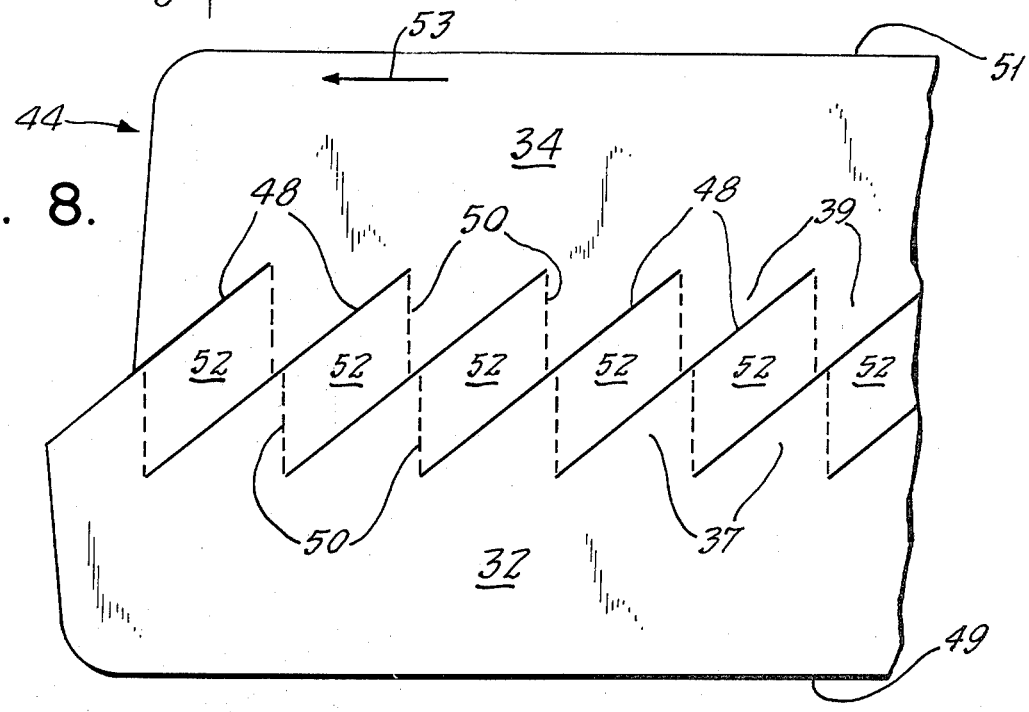
FIG. 8 is a top view of a portion of a blank of sheet blade metal from which the cutter structure shown in FIGS. 2 through 7 is formed.

The unitary cutting structure 30 is advantageously formed from a blank 44 of sheet blade metal as shown in FIG. 8. The blank 44 is preferably of stainless steel alloy suitable for providing knife edges. This blank is initially formed to include a plurality of parallel, staggered slits 48 which extend diagonally at an angle of approximately 40° to 45° with respect to the elongated portions 32 and 34 in the blank 44. As shown in FIG. 8, each slit is the same length and each slit is positioned at the same diagonal orientation relative to the long edges 49 and 51 of this blank 44. The regions of this metal blank 44 which will form the cutting edges 38 and 41 may be effectively sharpened by deforming the metal blank to raise the edges of the slits 48 slightly and then by grinding the deformed blank to make it somewhat thinner in the region near the slits 48, thereby concentrating the grinding effect along the slits 48 for effectively sharpening what will become the leading cutting edges 38 and 41 of the julienne cutter structure 30.

A plurality of bend lines 50 are established parallel to each other and located at the opposite ends of each slit 48. Then the blades 36 of the cutting structure 30 are formed by the metal strips 52 located between the diagnoal slits 48. The upright blades 36 are formed by bending this blank 44 along the respective bend lines 50 while lifting the upper elongated portion 34 and also shifting it to the left relative to the lower elongated portion 32 as indicated by the shift motion arrow 53.

This bending, lifting and shifting metal-forming action in effect brings the diagonal parallelogram-shaped strips 52 of metal defined between the respective slits 48 and between the respective bend lines 50 up into vertical parallel planes as seen in FIG. 6 to produce the respective blades 36. Thus, these multiple small blades 36 are integral with both the lower and upper elongated portions 32 and 34 of the original sheet metal blank 44, being connected thereto by the triangular-shaped metal portions 37 and 39. By virtue of the fact that the upright blade edges 38 are sharpened along with the leading upper knife edges 41, the cutting configuration illustrated in FIG. 6 is thus presented to food items through which the cutting structure 30 is moving at relatively high speed during rotation of the tool in the direction 27.

The unitary cutter structure 30 is installed in the disc-like member 22 by positioning the elongated lower portion 32 beneath the disc 22 immediately in front of the leading edge of the slot 26 and aligned with the slot. At the same time, the elevated elongated upper portion 34 is positioned on top of the leading edge portion 29 of the elevated platform 28 at the trailing edge of the slot 26 and is aligned with the slot. This leading edge 29 is chamfered as shown at 46 in FIG. 7 to avoid damaging the julienne strips. When the cutter structure 30 is positioned in this manner, as shown in FIG. 7, the blades 36 extend upwardly through the slot 26 providing a series of vertically extending cutting edges 38 which are perpendicularly positioned with respect to the upper and lower portions 32 and 34, respectively. The cutting structure 30 is secured to the disc 22 by means of a plurality of spot welds 55 to form a rigid assembly. One row of spot welds 55 secures the elongated metal portion 32 to the underside of the disc number 22. Another row of spot welds secures the other elongated metal portion 34 to the upperside of the elevated platform 28 in the region 29 near the slot 26.

It will now be seen that there has been provided a julienne cutter 20 which has a simple, rugged construction which is not only easy to install but can withstand the repeated cutting impacts to which it is subjected as it rapidly rotates in a food processor and contacts food items which are to be cut into julienne strips. The blades 36 are integrally connected to both the lower and upper structure of the cutting tool such that the blades will not be deflected, as they might be if one end thereof were free.

The upper and lower triangular base portions 39 and 37, respectively also form guides for the julienne strips as they are passed through the rectangular cutter openings 42 in the cutting means 30. This guidance helps to shape the julienne strips and support them as they are being formed and cut by the leading upper knife edges 41 which in effect slice horizontally along a line through the food item and a plurality of radially spaced vertical knife edges 38 which are positioned to slice the item along radially spaced planes perpendicular to the horizontal line of the edges 41 to form the julienne strips of substantially rectangular cross section. In this example, the julienne strips which are produced have a square cross section measuring 2 millimeters on each side.

It will be understood with respect to the blades 36 which have been described as a plurality of relatively closely spaced blades which are arranged in a row radially with respect to the axis of rotation as well as extending upwardly and perpendicularly to the elongated lower and elevated upper portions of the unitary cutting structure that such terminology is intended to include any modest variations in the actual configurations of such small blades spanning across from top to bottom of the opening and being integrally connected at top and bottom to elongated portions of a sheet metal blank forming an integral structure which is secured within the opening 26 for producing multiple cuts in food material for making julienne strips and similar small strips from the food items.

As shown in FIG. 7 the leading edge region of the elongated upper portion 34 projects forward beyond the chamfered leading edge 46 of the elevated platform 28 and is inclined upwardly above the horizontal platform at a small angle in the range from 3° to 9° for causing the sharpened cutting edges 41 of the triangular bases 39 to produce a neat, clean slicing action in cutting the small cross section julienne strips.

In the foregoing illustrative example of the invention the hub 18 is secured to the disc-like members 22 concentric with the axis 21 of rotation. However, it is to be understood that the hub, where it is secured to the disc 22 may be offset from the axis of rotation, for example being offset as shown in U.S. Pat. No. 4,227,655 to which reference is made in the introduction. Such an offset hub arrangement advantageously provides room in a disc of given diameter for accommodating a longer opening 26 and a longer row of blades 36 than can be accommodated with a concentrically located hub in each disc. Therefore, the following claims are not intended to be limited to a tool having a centrally positioned hub in the disc-like member.

Since other changes and modifications varied to fit particular operating requirements and environments will be apparent to those skilled in the art, the invention is not to be considered limited to the specific example chosen for purposes of illustration, and covers all changes and modifications which do not constitute a departure from the true spirit and scope of this invention as defined by the following claims.

What is claimed is:

1. A julienne cutter tool for use in rotary food processors of the type having a working bowl with tool drive means extending into the bowl for rotating said julienne tool in said bowl in a predetermined direction about an axis, a removable cover for the bowl when in use, and a feed passage for introducing food material into the bowl, said julienne tool having a hub with a disc-like member secured to the hub, said disc-like member having a periphery and an elongated opening therein extending from a region near said hub to a region near the periphery of said disc-like member, said disc-like member having an elevated portion having a leading edge located behind said opening, and cutting means associated with said opening for producing multiple closely spaced cuts in food items applied thereto with the resultant cut strips passing through said opening into said bowl, said julienne cutting tool comprising:

a unitary integral cutting structure formed of sheet metal having an elongated lower portion integral with an elongated upper portion, which is at a higher elevation than said lower portion, said elongated lower portion of said integral cutting structure being secured beneath said disc-like member in front of said opening in said disc-like member, said elongated upper portion of said integral cutting structure being secured to the top of said elevated portion of said disc-like member behind said opening near to the leading edge of said elevated portion of said disc-like member, said elongated upper portion of said cutting structure projecting forward generally horizontally beyond the leading edge of said elevated portion of the disc-like member, said cutting structure including a row of relatively closely spaced, small parallel blades integral with both said upper and lower portions of said cutting structure, said row of blades being located in said elongated opening, said small, parallel blades extending upwardly relative to said disc-like member as seen looking at said row of blades in front elevation, each of said blades being integrally joined to said upper portion of the cutting structure by an upper triangular gusset, each of said blades being integrally joined to said lower portion of the cutting structure by a lower triangular gusset, said upper and lower triangular gussets extending generally horizontally in opposite directions from the respective blades, the leading edges of the upper triangular gussets being sharpened for forming a series of horizontally aligned knife edges, the leading edges of the blades also being sharpened, for said upper triangular gussets to make clean horizontal cuts in food items and for said blades to make uniformly spaced upright cuts in the food items for forming cleanly, uniformly, and neatly cut julienne strips when said cutter tool is rotated at high speed by the drive means in the food processor.

2. A julienne cutter tool as claimed in claim 1, in which:

said cutting structure is formed from a sheet metal blank having a row of diagonally oriented uniformly spaced slits therein defining parallelogram-shaped strips of metal between the respective slits, said blades in said cutting structure being formed by said parallelogram-shaped strips of metal after they have been bent into respective planes perpendicular to the planes of said elongated lower and upper portions of said cutting structure.

3. A julienne cutter tool as claimed in claim 1, in which:

said elongated opening in said disc extends radially with respect to the axis of rotation, and said row of small blades extends radially within said opening.

4. A julienne cutter tool as claimed in claim 1, in which:

the sharpened leading edges of said elongated upper portion where said triangular gussets are located is inclined upwardly at a small angle above the level of the top of said elevated portion of said disc-like member.

5. A julienne cutter tool as claimed in claim 1, in which:

said cutting structure is formed from a sheet metal blank having a row of diagonally oriented uniformly spaced slits aligned in a row and defining parallelogram-shaped strips of metal between the respective strips, and said blank has a first elongated portion connected to one end of all of said strips and has a second elongated portion connected to the other end of all of said strips, said blades in said cutting structure being formed by said parallelogram-shaped strips of metal after they have been bent into respective planes perpendicular to the planes of said first and second elongated portions, and said first and second elongated portions of said blank form the elongated lower and elongated upper portions of said cutting structure.

* * * * *